US009033271B2

(12) United States Patent
Muto

(10) Patent No.: US 9,033,271 B2
(45) Date of Patent: May 19, 2015

(54) WIRE WINDING APPARATUS AND WIRE WINDING METHOD

(71) Applicant: NITTOKU ENGINEERING CO., LTD., Saitama-shi, Saitama (JP)

(72) Inventor: Kenichi Muto, Fukushima (JP)

(73) Assignee: NITTOKU ENGINEERING CO., LTD., Saitama (JP)

( * ) Notice: Subject to any disclaimer, the term of this patent is extended or adjusted under 35 U.S.C. 154(b) by 146 days.

(21) Appl. No.: 13/929,845

(22) Filed: Jun. 28, 2013

(65) Prior Publication Data

US 2014/0008482 A1 Jan. 9, 2014

(30) Foreign Application Priority Data

Jul. 3, 2012 (JP) ..... 2012-148980

(51) Int. Cl.
*B21C 47/10* (2006.01)
*B65H 54/28* (2006.01)
*H01F 41/06* (2006.01)

(52) U.S. Cl.
CPC ..... *B65H 54/28* (2013.01); *H01F 41/0679* (2013.01); *H01F 41/0683* (2013.01)

(58) Field of Classification Search
USPC ..... 242/433.1, 433.2, 433.4, 445.1, 447
See application file for complete search history.

(56) References Cited

U.S. PATENT DOCUMENTS 5,988,554 A * 11/1999 Taka ..... 242/433.1
8,919,685 B2 * 12/2014 Tassinario et al. ..... 242/433.1
2002/0079399 A1 * 6/2002 Dolgas et al. ..... 242/433.1
2011/0114781 A1 * 5/2011 Kimura et al. ..... 242/443

FOREIGN PATENT DOCUMENTS

JP 2002-184640 A 6/2002

* cited by examiner

*Primary Examiner* — Emmanuel M Marcelo
(74) *Attorney, Agent, or Firm* — Lowe Hauptman & Ham, LLP

(57) ABSTRACT

The wire winding apparatus includes: a wire feeding member provided to a supporting member so as to be operable, for feeding a wire; a lock mechanism capable of inhibiting an operation of the wire feeding member; a winding mechanism for rotating a core about an axis thereof to wind the wire fed from the wire feeding member around the outer circumference of the core; a feed mechanism for moving the supporting member in an axial direction of the core in synchronization with the winding performed by the winding mechanism; a proximity sensor for detecting a movement amount of the wire feeding member with respect to the supporting member; and a control section for controlling an operation of the feed mechanism to adjust a movement amount of the supporting member moved by the feed mechanism based on a detection output from the proximity sensor.

5 Claims, 9 Drawing Sheets

WIRE WINDING APPARATUS AND WIRE WINDING METHOD

FIELD OF THE INVENTION

The present invention relates to a wire winding apparatus and a wire winding method for winding a wire around a core by regular winding.

BACKGROUND OF THE INVENTION

Conventionally, there is known a wire winding apparatus for winding a wire around a core such as a bobbin, for example, by regular winding. The wire winding apparatus winds the wire so that turns of the wire formed around an outer circumference of the core are aligned with each other in an axial direction of the core. As the wire winding apparatus described above, there is known a wire winding apparatus for regular winding with pitch feeding. This wire winding apparatus winds the wire while shifting a feed mechanism for feeding the wire in the axial direction of the core by the amount equal to a diameter of the wire for each turn of the wire.

With the regular winding with pitch feeding, however, the wire is not always wound as initially planned. For example, in some cases, the diameter of the wire to be wound around the core is not constant but is varied. Moreover, even when the diameter of the wire is constant, there is a fear in that the diameter of the wire may be changed as a result of the extension of the wire that is caused by a tension applied during the wire winding. Therefore, even with the pitch feeding of the feeding mechanism based on a preset diameter of the wire, there is a fear in that the pitch feeding may not always suit for an actual diameter of the wire.

In order to avoid the problem described above, for example, Japanese Patent Application Laid-open No. 2002-184640 proposes a wire winding apparatus using profile winding. The wire winding apparatus includes a pulley and a supporting member. The pulley is a wire feeding member for feeding the wire. The supporting member turnably supports a base end of an arm. The pulley is provided to a distal end of the arm. The pulley is configured to be operable through an intermediation of the arm, and hence the profile winding can be carried out. With the profile winding, the wire is guided by the last formed turn around the core so as to be subsequently wound around the core. By the profile winding, the wire is wound along a side surface of the last formed turn of the wire (along the wire) to achieve regular winding. In this manner, even when the diameter of the wire is undesirably changed, the wire is wound along the last formed turn of the wire.

SUMMARY OF THE INVENTION

In the conventional wire winding apparatus described above, however, the range of operation of the wire feeding member is limited. Therefore, when the wire is to be wound around, for example, a core having a relatively large length by using the profile winding, there is a fear in that the accumulation of errors in the diameter of the wire to be wound around the core may exceed the range of operation of the wire feeding member even when the wire is wound while the wire feeding mechanism is shifted in the axial direction of the core by the amount equal to the diameter of the wire for each turn. As a result, there is a fear in that a winding finish portion of the wire wound around the core cannot absorb the error in the diameter of the wire, which exceeds the range of operation of the wire feeding member, to generate a gap between the turns of the wire or to disadvantageously wind the wire on the already formed turn of the wire. Consequently, the regular winding for winding the wire so that the turns of the wire are formed so as to be uniformly held in close contact with each other becomes difficult.

In this case, the following method is also conceivable. Specifically, the amount of errors absorbed by the pulley, resulting from the accumulation of the errors in the diameter of the wire, is detected to correct the amount of shift of the pulley. In the conventional wire winding apparatus described above, the pulley is provided to the distal end of the arm, and the amount of turning of the arm is detected by an encoder. Even when the amount of turning of the arm is detected, however, the amount of errors absorbed by the pulley cannot be detected in an extremely small unit. Thus, it is difficult to adjust the amount of shift of the wire feeding member in an extremely small unit.

Moreover, a distance from the core to the pulley provided to the distal end of the arm tends to increase when the arm is turned. When the distance from the core to the pulley increases, the amount of shift of the wire in the axial direction of the core increases until a preset length of the wire fed from the pulley reaches the core. As a result, a distance between the new turn of the wire and the turn adjacent thereto changes. Therefore, there is a fear in that the profile winding becomes difficult. In particular, when the core is thin and relatively long, and is likely to be curved due to its length, the core is pulled by the wire to be curved toward the wire feeding member to result in a larger amount of shift of the preset length of the wire fed from the pulley. Then, the profile winding of the wire around the core becomes further difficult. Therefore, the regular winding of the wire to uniformly wind the wire around the core over the entire length of the core tends to become difficult.

On the other hand, in recent years, the wire winding apparatus is required to perform both the regular winding and pitch winding. The wire is wound while being held in close contact with the core in the regular winding, whereas the wire is wound at a predetermined pitch without being held in close contact with the core in the pitch winding. As described above, the wire winding apparatus is required to be adaptable to diversified wire winding methods.

The present invention has been made to solve the problems described above, and therefore has an object to provide a wire winding apparatus and a wire winding method capable of winding a wire around an outer circumference of a core with a desired pitch even when the core is thin and relatively long.

According to one aspect of this invention, a wire winding apparatus for winding a wire around an outer circumference of a core is provided. The wire winding apparatus includes a wire feeding member provided to a supporting member so as to be operable, for feeding the wire, a lock mechanism capable of inhibiting an operation of the wire feeding member, a winding mechanism for rotating the core about an axis thereof to wind the wire fed from the wire feeding member around the outer circumference of the core, a feed mechanism for moving the supporting member in an axial direction of the core in synchronization with the winding performed by the winding mechanism, a proximity sensor for detecting a movement amount of the wire feeding member with respect to the supporting member, and a control section for controlling an operation of the feed mechanism to adjust a movement amount of the supporting member moved by the feed mechanism based on a detection output from the proximity sensor.

Moreover, according to another aspect of this invention, a wire winding method for moving a wire feeding member for feeding a wire in an axial direction of a core with respect to a supporting member while rotating the core about an axis thereof to wind the wire fed from the wire feeding member around the core is provided. The wire winding method includes a profile-winding step of adjusting a movement amount of the supporting member based on a detection output from a proximity sensor for detecting a movement amount of the wire feeding member with respect to the supporting member to wind the wire fed from the wire feeding member so as to be guided by a last formed turn of the wire around the core, and a wire-winding step of winding, with the wire feeding member being fixed, the wire fed from the wire feeding member around the core while moving the supporting member at a constant speed with respect to the core in a state in which movement of the wire feeding member with respect to the supporting member is inhibited.

EMBODIMENTS OF THE INVENTION

Now, a wire winding apparatus 10 and a wire winding method using the wire winding apparatus 10 according to an embodiment of the present invention are described referring to the accompanying drawings.

First, a configuration of the wire winding apparatus 10 is described.

Figure 1:
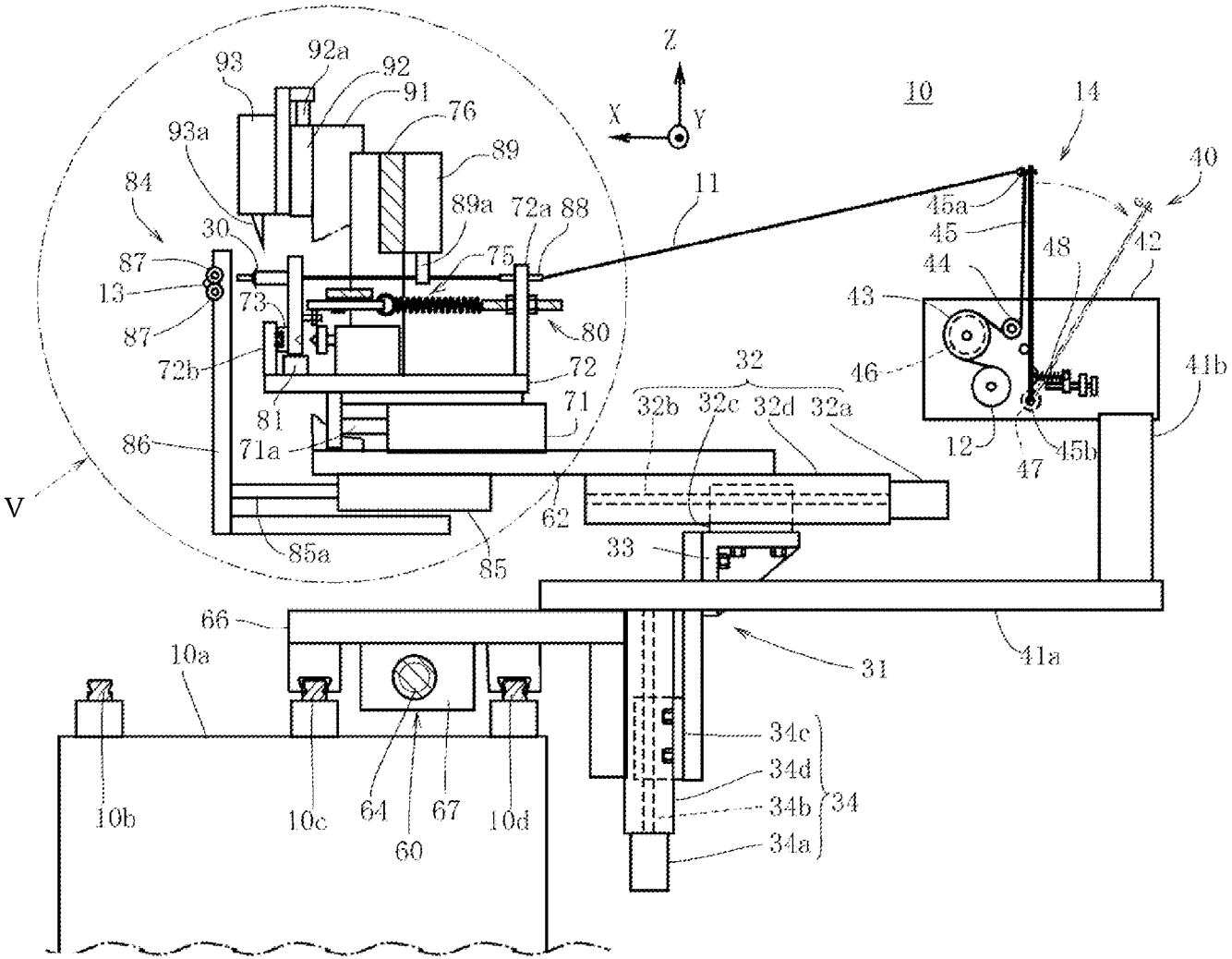
FIG. 1 is a side view of a wire winding apparatus according to an embodiment of the present invention.
Figure 2:
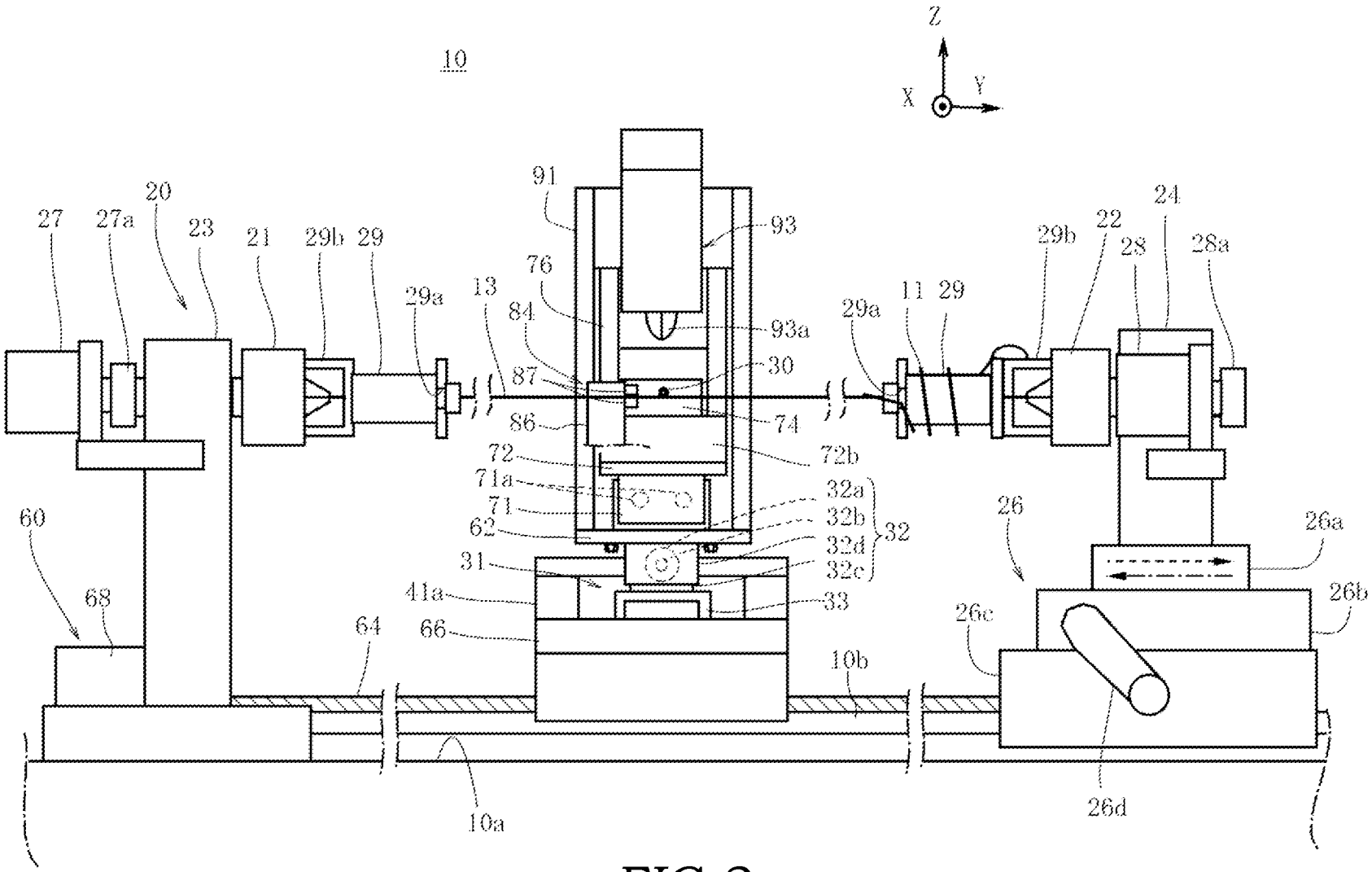
FIG. 2 is a front view of the wire winding apparatus illustrated in FIG. 1.
Figure 3:
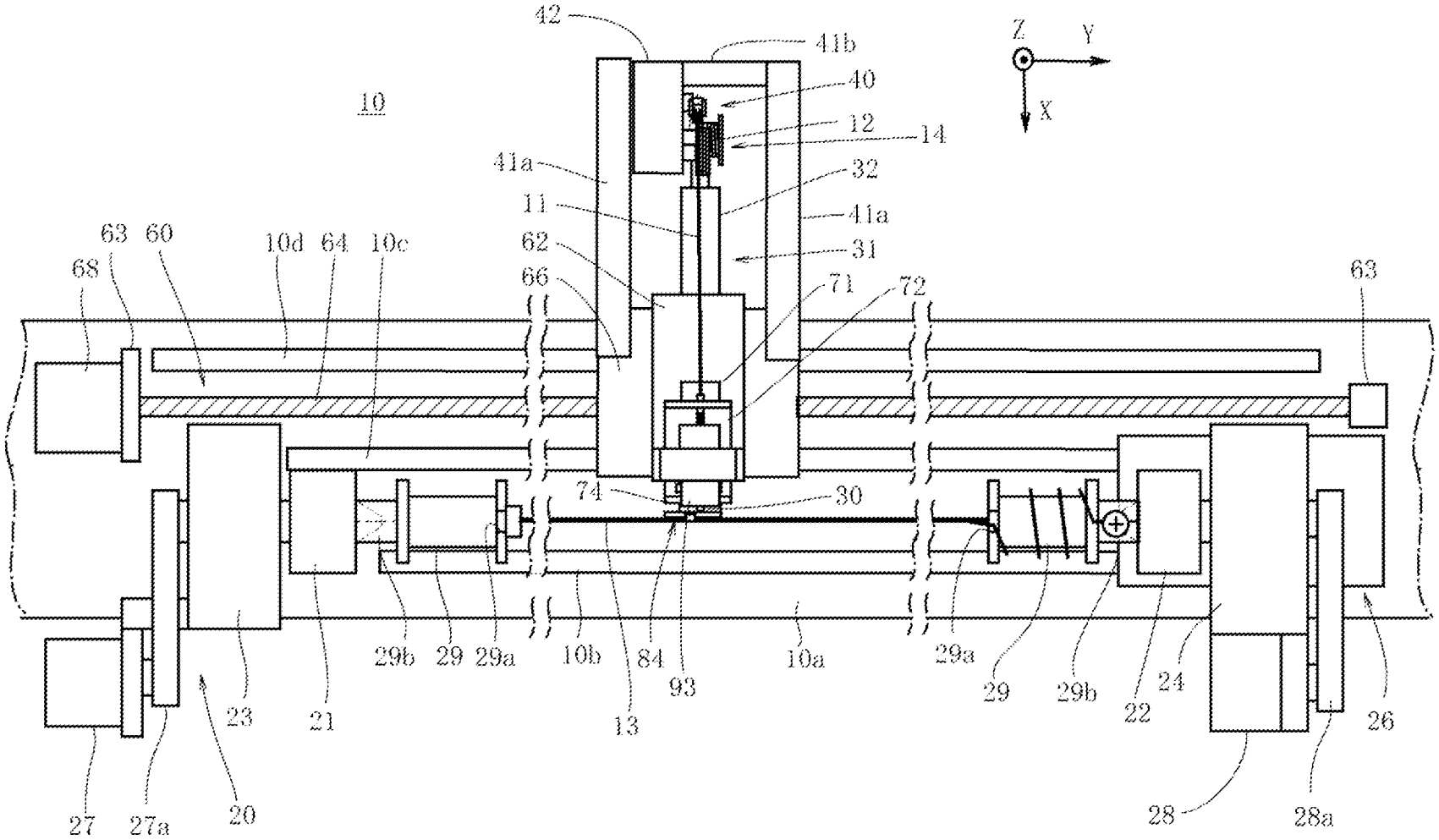
FIG. 3 is a plan view of the wire winding apparatus illustrated in FIG. 2.

As illustrated in FIGS. 1 to 3, the wire winding apparatus 10 winds a wire 11 fed from a wire feeding mechanism 14 around an outer circumference of a core 13 by regular winding. In this embodiment, a relatively thin and long linear material having a circular cross section is used as the core 13. However, the core 13 is not limited to the one having a circular cross section. The core 13 may have, for example, a rectangular cross section.

The wire winding apparatus 10 is hereinafter described using three axes, that is, an X axis, a Y axis, and a Z axis which perpendicularly cross each other. Specifically, a longitudinal direction within a horizontal plane is defined as the X axis, a transverse direction within the horizontal plane is defined as the Y axis, and a vertical direction is defined as the Z axis. The core 13 is provided to extend in the Y-axis direction in a tensioned state.

As illustrated in FIGS. 2 and 3, the wire winding apparatus 10 includes a winding mechanism 20. The winding mechanism 20 pulls the core 13 having a linear shape in the Y-axis direction and rotates the core 13 about a center axis to wind the wire 11 (see FIG. 1) fed through a nozzle 30 described later around the outer circumference of the core 13. In this embodiment, the core 13 is made of stainless steel, and has a cross section with a diameter of 0.2 mm and a relatively large length.

The winding mechanism 20 includes a fixed chuck mechanism 21 and a movable chuck mechanism 22. The fixed chuck mechanism 21 chucks one end of the core 13, whereas the movable chuck mechanism 22 is provided so as to be separated away from the fixed chuck mechanism 21 in the Y-axis direction and chucks another end of the core 13. The same mechanism may be used as the fixed chuck mechanism 21 and the movable chuck mechanism 22. As each of the fixed chuck mechanism 21 and the movable chuck mechanism 22, a drill chuck or a collet chuck, which are mechanical chucks, is used, for example. In this embodiment, the drill chuck is used as each of the fixed chuck mechanism 21 and the movable chuck mechanism 22.

The fixed chuck mechanism 21 is pivotably supported by a fixed bearing 23 provided on a base 10*a*. The movable chuck mechanism 22 is pivotably supported by a movable bearing 24. A first rail 10*b*, which extends from the fixed bearing 23 in the Y-axis direction, is provided on the base 10*a*. Two rails, that is, a second rail 10*c* and a third rail 10*d* are also provided on the base 10*a* at a predetermined distance away from the first rail 10*b* in the X-axis direction so as to be in parallel thereto (see FIG. 3). A chuck moving mechanism 26 is movably provided on the first rail 10*b* and the second rail 10*c*.

As illustrated in FIG. 2, the chuck moving mechanism 26 includes a movable base 26*c* and an air cylinder 26*b*. The movable base 26*c* is provided so as to be movable on the first rail 10*b* and the second rail 10*c*. The air cylinder 26*b* is provided on the movable base 26*c*. A movable base 26*a*, which is movable in the Y-axis direction in a reciprocating manner, is provided on the air cylinder 26*b*. The movable bearing 24 is mounted on the movable base 26*a*.

The movable base 26*c* moves in the Y-axis direction along the first rail 10*b* and the second rail 10*c* so that the core 13 having a different length can be provided in a tensioned state. An operation handle 26*d* is provided to switch over between a state in which the movement of the movable base 26*c* is allowed and a state in which the movement is inhibited. The movement of the movable base 26*c* is inhibited by the operation of the operation handle 26*d* in a state in which the movable base 26*c* is separated away from the fixed bearing 23 by a distance corresponding to the length of the core 13. The movable base 26*c* is used without being allowed to move unless there arises a situation where the length of the core 13 is changed or the like.

The air cylinder 26*b* can move the movable base 26*a* in the Y-axis direction in a reciprocating manner by supplying compressed air and stopping the supply of the compressed air. The air cylinder 26*b* moves the movable bearing 24 together with the movable base 26*a* to move the movable chuck mechanism 22 away from the fixed chuck mechanism 21 to pull the core 13. In this manner, the core 13 can be provided in a tensioned state between the fixed chuck mechanism 21 and the movable chuck mechanism 22.

Moreover, the winding mechanism 20 includes a core rotating mechanism. The core rotating mechanism rotates the core 13 provided in a tensioned state to wind the wire 11 fed from the wire feeding mechanism 14 (see FIG. 1) through the nozzle 30 around the core 13. In this embodiment, the core rotating mechanism is provided as chuck servomotors 27 and 28 which are rotationally driven by a command from a controller (not shown) provided as a control section.

As illustrated in FIGS. 2 and 3, the chuck servomotor 27 is provided to the fixed bearing 23, whereas the chuck servomotor 28 is provided to the movable bearing 24. A belt 27*a* is provided between a rotary shaft of the chuck servomotor 27 and the fixed chuck mechanism 21. A belt 28*a* is provided between a rotary shaft of the chuck servomotor 28 and the movable chuck mechanism 22. When the chuck servomotors 27 and 28 are driven by a command from the controller to rotate the rotary shafts of the chuck servomotors 27 and 28 in the same direction, the chuck mechanisms 21 and 22 rotate in synchronization with each other in the same direction through an intermediation of the belts 27*a* and 28*a*. Therefore, the winding mechanism 20 can rotate the core 13 without twisting the core 13.

A reel 29 capable of winding the wire 11 is provided to each of the fixed chuck mechanism 21 and the movable chuck mechanism 22. The reels 29 have the same structure. The reel 29 is provided to each of the fixed chuck mechanism 21 and the movable chuck mechanism 22 so as to be coaxial therewith through an intermediation of a mounting member 29*b*.

A center hole, through which the core 13 can be inserted, is formed to pass through a center axis of each of the reels 29. The one end of the core 13 inserted through the center hole is chucked by the movable chuck mechanism 22, whereas the another end is chucked by the fixed chuck mechanism 21. Although not shown, a distal end of the wire 11 fed through the nozzle 30 can be fixed to the mounting member 29*b* of the movable chuck mechanism 22. A plurality of cutouts 29*a* for drawing the wire 11 wound around the reel 29 toward the core 13 are formed on a side surface of each of the reels 29.

The reel 29 is mounted to each of the fixed chuck mechanism 21 and the movable chuck mechanism 22. With this configuration, when the fixed chuck mechanism 21 and the movable chuck mechanism 22 are respectively rotated by the servomotors 27 and 28, the reels 29 rotate together with the fixed chuck mechanism 21 and the movable chuck mechanism 22. In this manner, the wire 11 fed through the nozzle 30 is wound, and can be then drawn from through one of the cutouts 29*a* toward the core 13.

As illustrated in FIGS. 1 to 3, the wire winding apparatus 10 includes a feed mechanism 60. The feed mechanism 60 moves the nozzle 30 provided as a wire feeding member in the axial direction of the core 13 through an intermediation of a supporting member 72 in synchronization with the winding of the wire 11 by the winding mechanism 20.

A threaded shaft 64 is provided between the second rail 10*c* and the third rail 10*d* so as to be in parallel to the second rail 10*c* and the third rail 10*d*. Pivotably-supporting bases 63 are provided on both ends of the base 10*a* in the Y-axis direction (see FIG. 3). Both ends of the threaded shaft 64 are pivotably supported by the pivotably-supporting bases 63, respectively.

A movable plate 66 is provided on the second rail 10*c* and the third rail 10*d* so as to be movable in the longitudinal direction of the second rail 10*c* and the third rail 10*d*. A threaded member 67 (see FIG. 1) fitted over the threaded shaft 64 is fixed on the movable plate 66. A driving motor 68 to be controlled by the controller is mounted on one of the pivotably-supporting bases 63. The threaded shaft 64 is coupled to a rotary shaft of the driving motor 68. When the threaded shaft 64 is rotated by driving the driving motor 68, the threaded member 67 fitted over the threaded shaft 64 can move together with the movable plate 66 in the longitudinal direction along the second rail 10*c* and the third rail 10*d*.

As illustrated in FIG. 1, the wire feeding mechanism 14 for feeding the wire 11 is provided on the movable plate 66 of the feed mechanism 60. The wire feeding mechanism 14 includes a drum 12 and a tension applying mechanism 40. The drum 12 stores the wire 11 therein. The tension applying mechanism 40 applies a predetermined tension to the wire 11 fed from the drum 12.

Extension bases 41*a* extending in a direction away from the core 13 are provided on the movable plate 66. A supporting column 41*b* is provided to distal ends of the extension bases 41*a* so as to stand vertically thereon. The tension applying mechanism 40 includes a casing 42 provided on the supporting column 41*b*. The tension applying mechanism 40 includes a feeding control pulley 43, a guide pulley 44, and a tension bar 45, which are provided on a side surface of the casing 42 in the Y-axis direction. The drum 12 around which the wire 11 is wound is provided in the casing 42 in the vicinity of the feeding control pulley 43.

The wire 11 fed from the drum 12 is guided by the feeding control pulley 43 to be looped around the feeding control pulley 43. Then, after a direction of the wire 11 is changed by the guide pulley 44, the wire 11 is guided to a wire guide 45*a* provided at a distal end of the tension bar 45. The wire 11 guided to the wire guide 45*a* is fed from the wire guide 45*a* to the nozzle 30 described later.

The feeding control pulley 43 is directly coupled to a feeding control motor 46 which is received inside the casing 42. The tension bar 45 is turnable about a turning shaft 45*b* provided at a base end of the tension bar 45 as a fulcrum. A turning angle of the turning shaft 45*b* is detected by a potentiometer 47 provided as a turning-angle detector, which is received inside the casing 42 and mounted to the turning shaft 45*b*. An output from the potentiometer 47 is input to the controller. Then, a control signal from the controller is output to the feeding control motor 46.

A spring 48 is mounted at a predetermined position between the turning shaft 45*b* of the tension bar 45 and the wire guide 45*a*. The spring 48 is an elastic member provided as a biasing mechanism for applying a biasing force in a direction of turning of the tension bar 45. The biasing force in accordance with the turning angle is applied to the tension bar 45 by the spring 48. The controller controls the feeding control motor 46 so that the turning angle detected by the potentiometer 47 becomes equal to a predetermined angle. In the manner described above, the tension applying mechanism 40 applies a tension to the wire 11 by the spring 48 through an intermediation of the tension bar 45. Moreover, the feeding control pulley 43 rotates so that the tension bar 45 is turned at a predetermined angle. In this manner, the tension applying mechanism 40 can feed the wire 11 applied with a desired tension.

A mount 62 is mounted on the movable plate 66 through an intermediation of a nozzle moving mechanism 31. The nozzle moving mechanism 31 includes an X-axis direction extension actuator 32 and a Z-axis direction extension actuator 34. The X-axis direction extension actuator 32 includes a housing 32*d*, a servomotor 32*a*, a ball screw 32*b*, and a follower 32*c*, whereas the Z-axis direction extension actuator 34 includes a housing 34*d*, a servomotor 34*a*, a ball screw 34*b*, and a follower 34*c*. Each of the housing 32*d* and 34*d* has an elongated box-like shape. The ball screw 32*b* is provided inside the housing 32*d* to extend in the longitudinal direction, and is rotationally driven by the servomotor 32*a*. In the same fashion, the ball screw 34*b* is provided inside the housing 34*d* to extend in the longitudinal direction, and is rotationally driven by the servomotor 34*a*. The follower 32*c* is threadably fitted over the ball screw 32*b*, and moves in parallel thereto. In the same fashion, the follower 34*c* is threadably fitted over the ball screw 34*b*, and moves in parallel thereto. In the X-axis direction extension actuator 32, when the ball screw 32*b* is driven to be rotated by the servomotor 32*a*, the follower 32*c* fitted over the ball screw 32*b* can move along the longitudinal direction of the housing 32*d*. In the same manner, in the Z-axis direction extension actuator 34, when the ball screw 34*b* is driven to be rotated by the servomotor 34*a*, the follower 34*c* fitted over the ball screw 34*b* can move along the longitudinal direction of the housing 34*d*.

In this embodiment, the mount 62 is mounted to the housing 32*d* of the X-axis direction extension actuator 32 so as to be movable in the X-axis direction, and hence the mount 62 is movable in the Z-axis direction together with the X-axis direction extension actuator 32. The follower 32*c* is mounted to the follower 34*c* of the Z-axis direction extension actuator 34 through an intermediation of an L-shaped bracket 33. The housing 34*d* of the Z-axis direction extension actuator 34 is mounted along the Z-axis direction corresponding to a vertical direction with respect to the movable plate 66.

The servomotor 32*a* of the X-axis direction extension actuator 32 and the servomotor 34*a* of the Z-axis direction extension actuator 34 are connected to the controller which controls the servomotors 32*a* and 34*a*. The nozzle moving mechanism 31 including the X-axis direction extension actuator 32 and the Z-axis direction extension actuator 34 is driven by the command from the controller so as to move the mount 62 in the X-axis direction and the Z-axis direction with respect to the movable plate 66 as desired. In this manner, the nozzle moving mechanism 31 can control the nozzle 30 described later to face the core 13.

Figure 4:
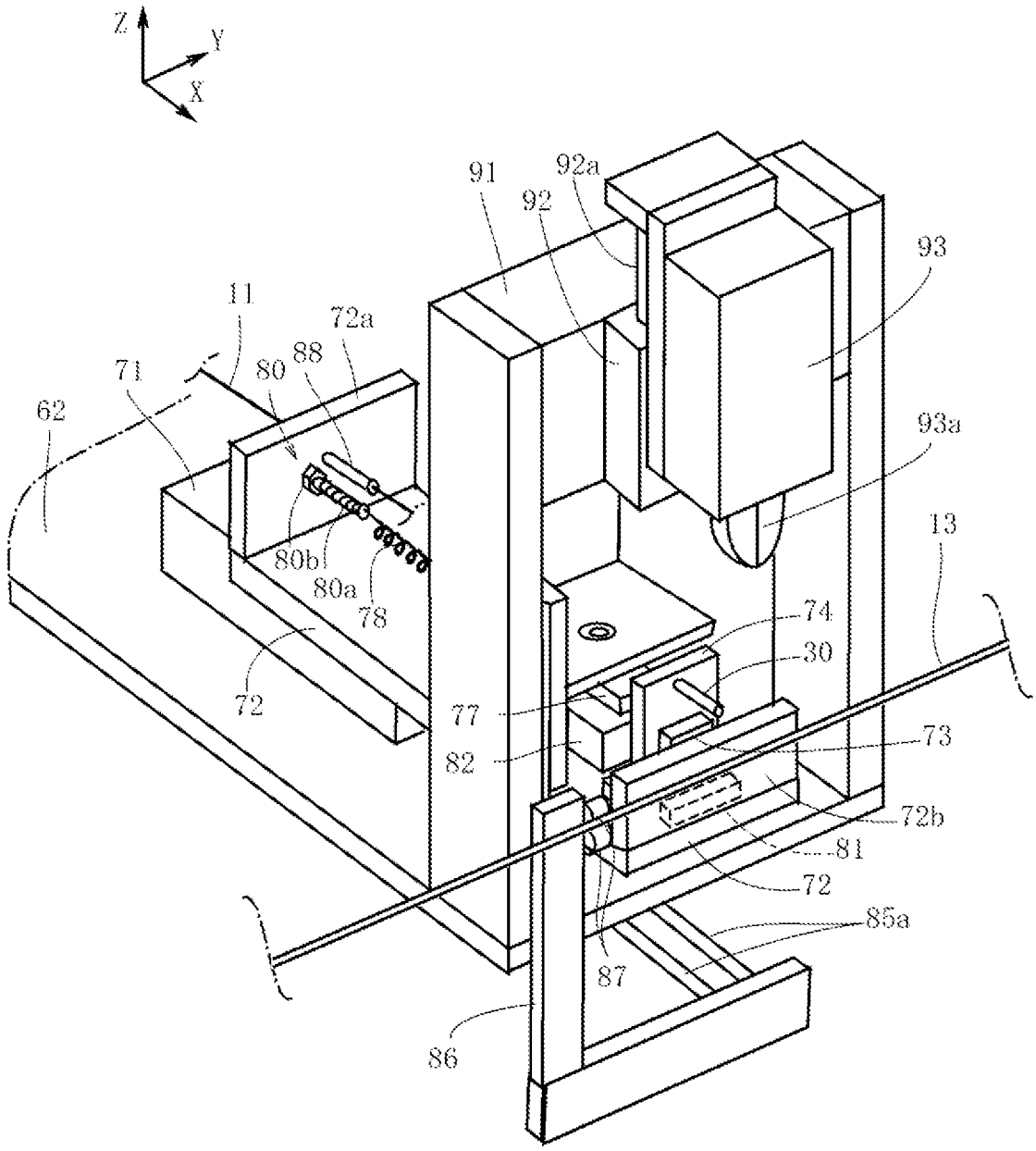
FIG. 4 is a perspective view illustrating the periphery of a nozzle of the wire winding apparatus.
Figure 5:
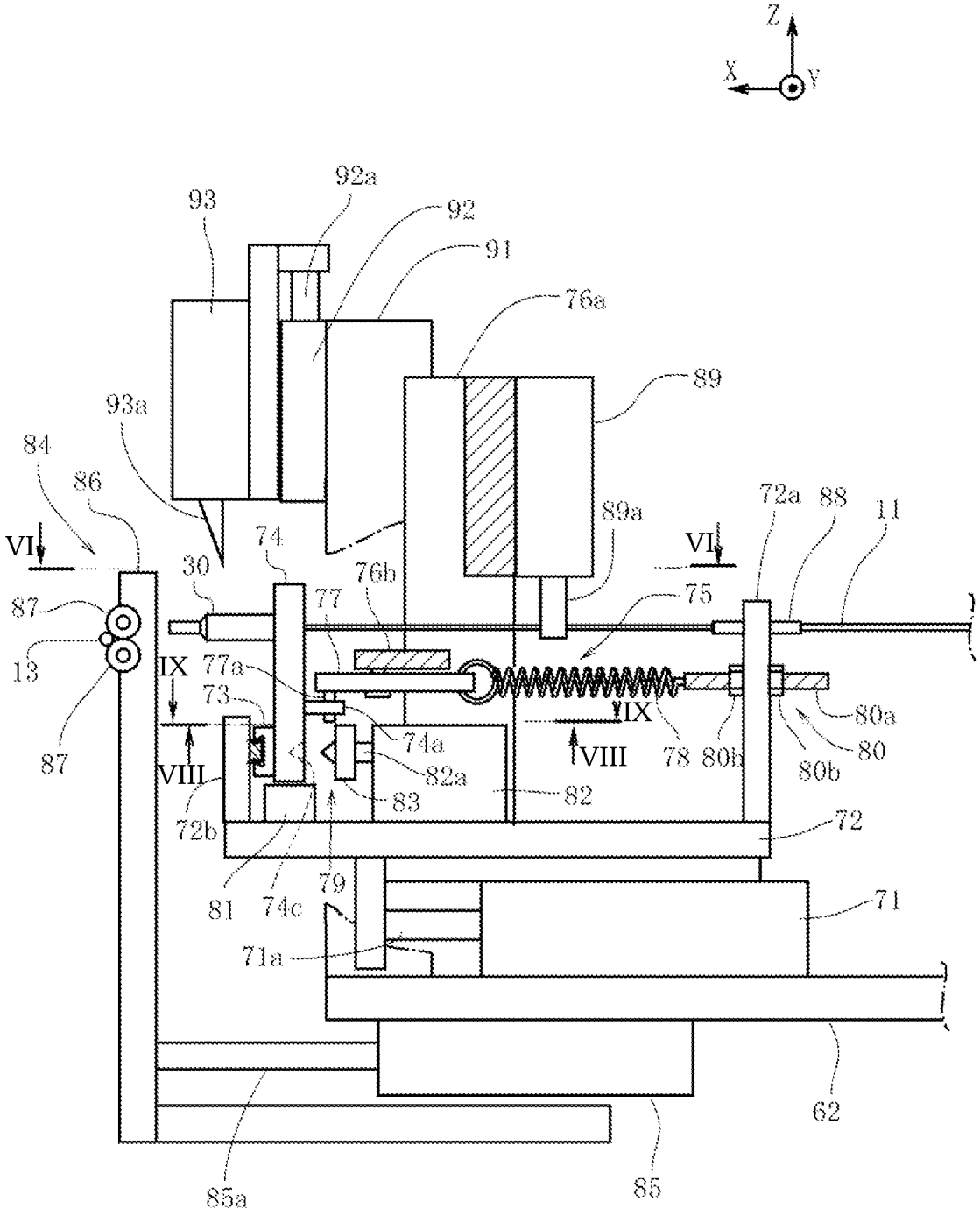
FIG. 5 is an enlarged view of the portion V of FIG. 1.

As illustrated in FIGS. 4 and 5, an air cylinder 71 is placed on the mount 62 so that a retractable rod 71*a* extends in the X-axis direction. The supporting member 72 is mounted to the retractable rod 71*a* of the air cylinder 71 so as to extend in a horizontal direction. A one-end plate 72*b* is provided to an end of the supporting member 72, which faces the core 13, so as to extend in the Z-axis direction. A mounting member 74 is mounted to the one-end plate 72*b* through an intermediation of a ball slide 73 so as to be movable in the Y-axis direction. The nozzle 30 which is the wire feeding member is mounted to the mounting member 74 with its center axis being oriented in the X-axis direction. As described above, the nozzle 30 is mounted to the supporting member 72 through an intermediation of the mounting member 74 so as to be movable in the axial direction of the core 13.

The air cylinder 71 projects or retracts the retractable rod 71*a* by a command from the controller. When the supporting member 72 moves closer to the core 13, the air cylinder 71 is driven to move the nozzle 30 closer to the core 13. On the other hand, when the supporting member 72 moves away from the core 13, the air cylinder 71 is driven to move the nozzle 30 away from the core 13.

A biasing mechanism 75 for biasing the nozzle 30 so that the nozzle 30 is located at a predetermined position above the supporting member 72 in the Y-axis direction is provided to the supporting member 72. In this embodiment, the predetermined position is approximately above the center of the supporting member 72 in the Y-axis direction. As illustrated in FIGS. 5 to 8, the biasing mechanism 75 includes a rotary plate 77. A pair of leg members 76*a* are provided on both ends of the supporting member 72 in the Y-axis direction so as to vertically stand upward thereon. A horizontal plate 76*b* is provided between the pair of leg members 76*a*.

The rotary plate 77 has a rotary shaft in the Z-axis direction, and is pivotably supported at approximately the center of the horizontal plate 76*b* in the Y-axis direction. A projection 77*a* is provided on an end of the rotary plate 77, which faces the nozzle 30, to extend downward in the Z-axis direction. A pair of sandwiching members 74*a* and 74*b* for sandwiching the projection 77*a* therebetween is provided to the mounting member 74 to which the nozzle 30 is mounted. The sandwiching members 74*a* and 74*b* are provided so as to extend in the X-axis direction.

Figure 6:
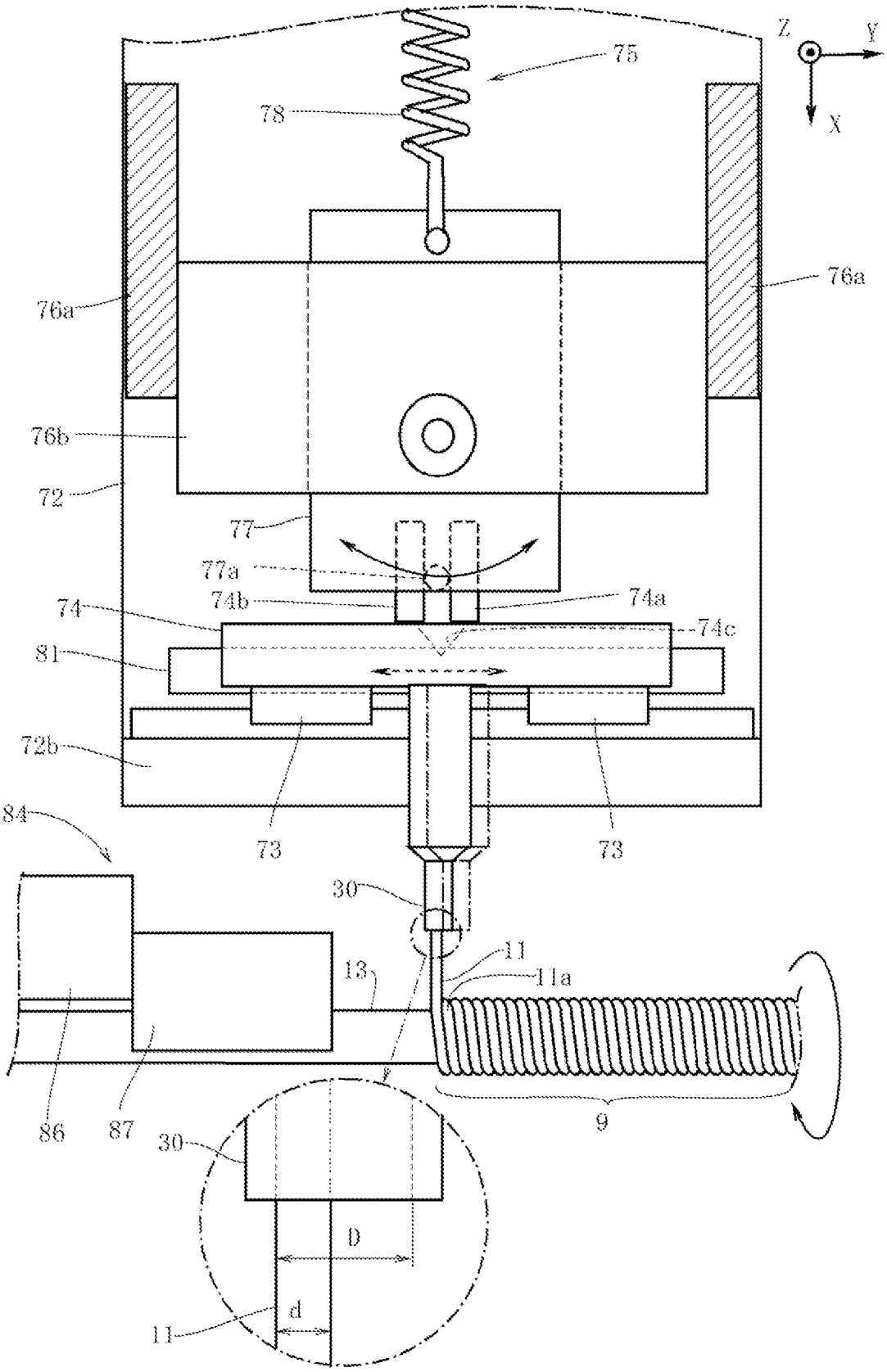
FIG. 6 is a sectional view taken along the line VI-VI of FIG. 5.

With the configuration described above, when the rotary plate 77 is rotated as indicated by the arrow in solid line in FIG. 6, the mounting member 74, on which the sandwiching members 74*a* and 74*b* for sandwiching the projection 77*a* therebetween are provided, is moved in the Y-axis direction indicated by the arrow in broken line with respect to the supporting member 72 by the projection 77*a* moving in a circumferential direction.

Figure 8:
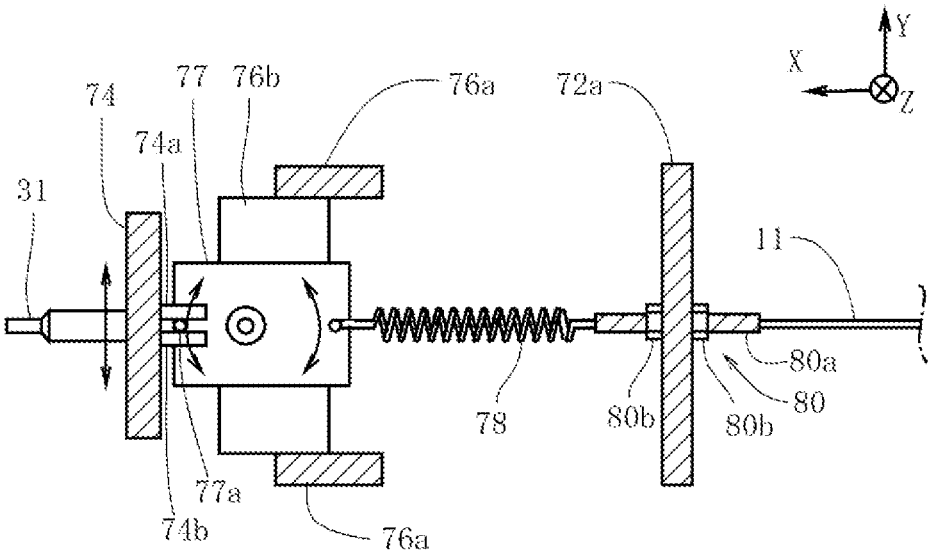
FIG. 8 is a sectional view taken along the line VIII-VIII of FIG. 5.

As illustrated in FIGS. 4, 6, and 8, an end of a spring 78 for applying an appropriate resistance to the rotation of the rotary plate 77 is coupled to an end of the rotary plate 77, which is on the side opposite to the side where the projection 77*a* is provided. On an end of the supporting member 72, which is on the side away from the core 13, an another-end plate 72*a* is provided so as to stand vertically thereon. Another end of the spring 78 is coupled to the another-end plate 72*a*. As a result, the spring 78 biases the end of the rotary plate 77, which is on the side opposite to the side where the projection 77*a* is provided, to pull the end of the rotary plate 77 toward the another-end plate 72*a*. When the rotary plate 77 is turned in this state, the biasing force of the spring 78 is exerted in a direction for restraining the turning. The biasing force of the spring 78 is exerted so as to locate the nozzle 30 in the predetermined position in the Y-axis direction above the supporting member 72.

Thus, by opposing the center of the supporting member 72 to a last formed turn 11*a* or a turn formed previous to the turn 11*a* (hereinafter referred to as "previous turn") of the wire 11 to be wound around the core 13, the nozzle 30 is caused to move so as to face the last formed turn 11 or the previous turn, as indicated by the alternate long and short dash line in FIG. 6. Therefore, the wire 11 fed through the nozzle 30 can be pressed against the last formed turn 11*a*. In this case, as illustrated in an enlarged part in FIG. 6, even when an inner diameter D of a distal end of the nozzle 30, through which the wire 11 is fed, is larger than an outer diameter d of the wire 11, the wire 11 fed through the nozzle 30 is pressed against the last formed turn 11*a*. As a result, the wire 11 can be stably fed obliquely from behind in a direction in which the wire winding proceeds for the nozzle 30.

As described above, when profile winding is performed, the center of the supporting member 72 is opposed to the last formed turn 11*a* or the previous turn of the wire 11 to be wound around of the core 13. As a result, the wire 11 can be wound around the core 13 so that the formed turns are located in close contact with each other. Therefore, regular winding which enables the turns formed by winding the wire 11 to be appropriately aligned in close contact with each other can be realized.

A biasing-force adjusting mechanism 80 is provided to the another-end plate 72*a*. The biasing-force adjusting mechanism 80 includes a threaded bar 80*a* and a nut 80*b*. The another end of the spring 78 is supported by the threaded bar 80*a*. The nut 80*b* can change a position on the another-end plate 72*a*, at which the threaded bar 80*a* is mounted. The biasing-force adjusting mechanism 80 moves the threaded bar 80*a* in the axial direction to change a total length of the spring 78 so as to adjust the biasing force of the spring 78. As a result, the magnitude of the biasing force of the spring 78 can be adjusted to be suitable for the profile winding.

As indicated by the alternate long and short dashed line in FIG. 6, when the nozzle 30 is to be opposed to the last formed turn 11*a* of the wire 11 to be wound around the core 13, a force required to rotate the rotary plate 77 is increased by increasing the biasing force of the spring 78. Therefore, the wire 11 to be wound is pressed against the last formed turn 11*a* with a large force. Therefore, the degree of contact with the last formed turn 11*a* becomes higher, but there is a higher risk in that the wire 11 is disadvantageously wound on the last formed turn 11*a*.

On the other hand, when the biasing force of the spring 78 is reduced, the force required for the rotation is also reduced. Therefore, the force for pressing the wire 11 to be wound against the last formed turn 11 also becomes smaller. Therefore, there is a lower risk in that the wire 11 is wound on the last formed turn 11*a*, but the degree of contact with the last formed turn 11*a* becomes smaller. Therefore, by appropriately setting the biasing force of the spring 78 in accordance with the winding state, the profile winding can be performed in a well-balanced manner.

A proximity sensor 81 is provided to the supporting member 72. The proximity sensor 81 detects the amount of movement of the mounting member 74, to which the nozzle 30 is mounted, with respect to the supporting member 72. The proximity sensor 81 is mounted to the supporting member 72 in a state in which the proximity sensor 81 is moved to be located close to the mounting member 74. In this manner, even an extremely small amount of movement of the mounting member 74 with respect to the supporting member 72 can be detected. A detection output from the proximity sensor 81 is input to the controller. Then, the controller adjusts the amount of movement of the supporting member 72 in the Y-axis direction by the feed mechanism 60 based on the detection output from the proximity sensor 81. As the kinds of adjustment performed by the controller, there are the following adjustments. Specifically, there are (1) an adjustment for setting the amount of movement of the nozzle 30 with respect to the supporting member 72 to zero, and (2) an adjustment without moving the supporting member 72 when the amount of movement of the nozzle 30 with respect to the supporting member 72 is smaller than a predetermined upper-limit value (for example, 0.1 mm) and for moving the supporting member 72 so that the amount of movement of the nozzle 30 with respect to the supporting member 72 becomes zero each time the amount of movement equal to or larger than the upper-limit value is detected.

The adjustment (1) for setting the amount of movement of the nozzle 30 with respect to the supporting member 72 to zero is specifically described. The controller controls the feed mechanism 60 to move the supporting member 72 by a length equal to a diameter of the wire 11 during a period in which the core 13 rotates at 360 degrees. Then, when the diameter of the wire 11 is larger than a prescribed wire diameter, the nozzle 30 moves forward with respect to the supporting member 72. When the amount of forward movement of the nozzle 30 with respect to the supporting member 72 is detected by the proximity sensor 81, the controller controls the feed mechanism 60 to move the supporting member 72 excessively by the amount equal to the excessive amount of forward movement of the nozzle 30 during a period in which the core 13 rotates at another 360 degrees. In this manner, the amount of movement of the nozzle 30 with respect to the supporting member 72 is set to zero.

On the other hand, when the diameter of the wire 11 is smaller than the prescribed wire diameter, the nozzle 30 is delayed from the supporting member 72. Specifically, the nozzle 30 moves while being located behind in the winding direction with respect to the supporting member 72. When the proximity sensor 81 detects the amount of delay of the nozzle 30 from the supporting member 72, the controller controls the feed mechanism 60 to delay the movement of the supporting member 72 by the amount corresponding to the delay of the nozzle 30 during a period in which the core 13 rotates at another 360 degrees. In this manner, the amount of movement of the nozzle 30 with respect to the supporting member 72 is set to zero.

Figure 9:
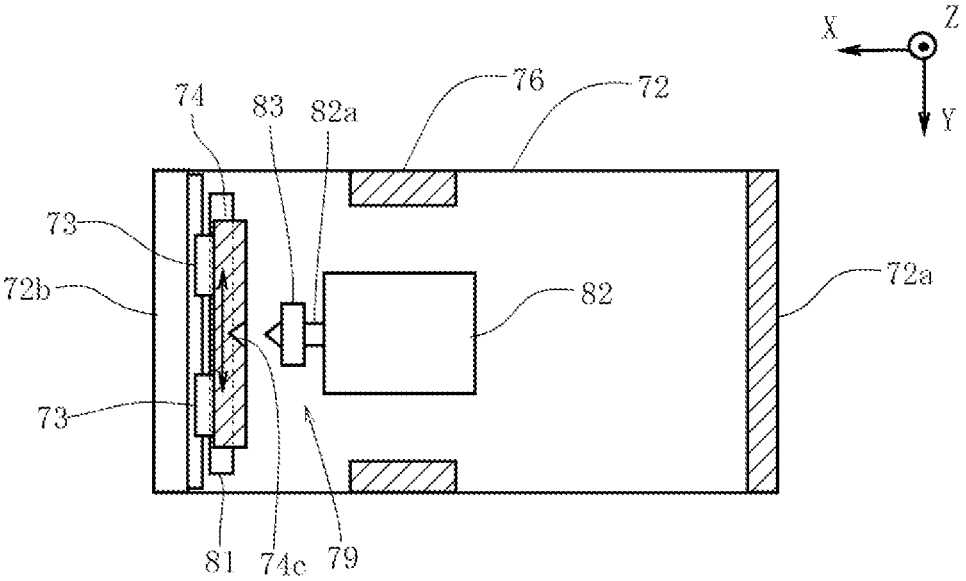
FIG. 9 is a sectional view taken along the line IX-IX of FIG. 5.

As illustrated in FIGS. 5 and 9, an engagement concave portion 74*c* having a conical shape is formed on the mounting member 74. The engagement concave portion 74*c* is formed so as to be open to the side opposite to the side facing the core 13. A rotation-restraining cylinder 82 facing the engagement concave portion 74*c* is provided to the supporting member 72. A convex engagement member 83 directly facing the engagement concave portion 74*c* is mounted to a rod 82*a* of the rotation-restraining cylinder 82.

When the rod 82*a* of the rotation-restraining cylinder 82 projects, the rotation-restraining cylinder 82 moves the convex engagement member 83 provided to the distal end of the rod 82*a* into the engagement concave portion 74*c*. When moving into the engagement concave portion 74*c*, the convex engagement member 83 inhibits the free movement of the mounting member 74 with respect to the supporting member 72.

On the other hand, when the rod 82*a* of the rotation-restraining cylinder 82 is retracted, the rotation-restraining cylinder 82 disengages the convex engagement member 83 provided to the distal end of the rod 82*a* from the engagement concave portion 74*c*. When being disengaged from the engagement concave portion 74*c*, the convex engagement member 83 allows the free movement of the mounting member 74 with respect to the supporting member 72.

Therefore, the engagement concave portion 74*c*, the convex engagement member 83, and the rotation-restraining cylinder 82 constitute a lock mechanism 79. The lock mechanism 79 inhibits the free movement of the nozzle 30 with respect to the supporting member 72 to lock the operation of the nozzle 30. By inhibiting the free movement of the nozzle 30 in this manner, wire-winding steps (for example, setting the wire to a winding start position or regular winding with pitch feeding), which are different from the profile winding described later, can be appropriately carried out.

As illustrated in FIGS. 4 to 7, the core 13 is a linear material in this embodiment. Therefore, a guide member 84 for supporting the core 13 is provided in the vicinity of the nozzle 30. The guide member 84 includes an air cylinder 85, a vertical member 86, and a pair of rollers 87. The air cylinder 85 is provided below a lower surface of the supporting member 72 so that a retractable rod 85*a* is oriented in the X-axis direction. The vertical member 86 is provided to the retractable rod 85*a* of the air cylinder 85. The pair of rollers 87 is provided on a front surface of the vertical member 86, which faces the core 13, so as to support the core 13.

The air cylinder 85 projects the retractable rod 85*a* by a command from the controller. As a result, the vertical member 86 moves closer to the core 13 from the nozzle 30 side. Then, the pair of rollers 87 provided to the vertical member 86 supports the core 13 from the side where the nozzle 30 is provided in the X-axis direction. Thus, the core 13 made of a linear material can be prevented from being curved toward the nozzle 30. On the other hand, when the retractable rod 85*a* of the air cylinder 85 is retracted, the air cylinder 85 moves the vertical member 86 together with the pair of rollers 87 away from the core 13.

As illustrated in FIGS. 4 and 5, a covering member 91 which covers the nozzle 30 from above is provided to the mount 62. A nipper mechanism 93 capable of cutting the wire 11 is provided to the covering member 91 through an intermediation of a vertically-movable cylinder 92. The vertically-movable cylinder 92 is mounted to the covering member 91 so that a retractable rod 92*a* is oriented in the vertical direction.

The vertically-movable cylinder 92 is mounted to the retractable rod 92*a* so that cutting blades 93*a* of the nipper mechanism 93 face the nozzle 30 or the wire 11 fed through the nozzle 30.

When the vertically-movable cylinder 92 moves down the nipper mechanism 93 in a state in which the supporting member 72 is moved away from the core 13, the cutting blades 93*a* of the nipper mechanism 93 sandwich the wire 11 fed through the nozzle 30. Then, the nipper mechanism 93 can cut the wire 11 with the cutting blades 93*a* by a command from the controller.

On the other hand, as illustrated in FIG. 5, an auxiliary nozzle 88 coaxial with the nozzle 30 is provided to the another-end plate 72*a*. After the wire 11 fed from the wire feeding mechanism 14 passes through the auxiliary nozzle 88, the wire 11 is guided to the nozzle 30. A clamp mechanism 89 for releasably gripping the wire 11 between the auxiliary nozzle 88 and the nozzle 30 with sandwiching teeth 89*a* is provided to the pair of leg members 76*a* which is provided on the supporting member 72 so as to vertically stand thereon.

The clamp mechanism 89 grips the wire 11 with the sandwiching teeth 89*a* by a command from the controller. As a result, the clamp mechanism 89 inhibits the feeding of the wire 11 through the nozzle 30. Even when the wire 11 is cut by the nipper mechanism 93, the clamp mechanism 89 prevents the wire 11 from returning toward the wire feeding mechanism 14. On the other hand, when the clamp mechanism 89 stops gripping the wire 11 with the sandwiching teeth 89*a* to release the wire 11, the wire 11 is allowed to be fed through the nozzle 30.

Next, a wire winding method using the wire winding apparatus 10 is described.

In the wire winding method according to this embodiment, the nozzle 30 for feeding the wire 11 is moved in the axial direction of the core 13 with respect to the supporting member 72 while rotating the core 13 about the axis, and the wire 11 fed through the nozzle 30 is wound around the core 13. The wire winding method includes a profile-winding step and a wire-winding step with the nozzle 30 being fixed. In the profile-winding step, the amount of movement of the supporting member 72 is adjusted based on the detection output from the proximity sensor 81 for detecting the amount of movement of the nozzle 30 with respect to the supporting member 72 so that the wire 11 fed through the nozzle 30 is guided to the last formed turn of the wire 11 and is wound around the core 13. In the wire-winding step with the nozzle 30 being fixed, the supporting member 72 is moved at a constant speed with respect to the core 13 in a state in which the movement of the nozzle 30 with respect to the supporting member 72 is inhibited to wind the wire 11 fed through the nozzle 30 around the core 13.

Now, the wire winding method using the wire winding apparatus 10 is described in accordance with a specific procedure.

In this embodiment, the core 13 made of a relatively thin and long linear material is used. Therefore, the core 13 is provided in a tensioned state to wind the wire. First, the one end of the core 13 is chucked by the fixed chuck mechanism 21, and then the another end of the core 13 is chucked by the movable chuck mechanism 22. At this time, by operating the operation handle 26*d* in a state in which the movable base 26*c* is separated away from the fixed bearing 23 by a distance corresponding to the length of the core 13, the movable base 26*c* of the chuck moving mechanism 26 is placed in a state in which the movement is inhibited.

Specifically, when the another end of the core 13 is to be chucked by the movable chuck mechanism 22, the movable base 26*a* of the chuck moving mechanism 26 is located close to the fixed chuck mechanism 21. Then, after the another end of the core 13 is chucked by the movable chuck mechanism 22, the movable base 26*a* of the chuck moving mechanism 26 is moved together with the movable bearing 24 as indicated by the arrow in broken line in FIG. 2. By moving the movable chuck mechanism 22 pivotably supported by the movable bearing 24 away from the fixed chuck mechanism 21, the core 13 is pulled to be provided between the fixed chuck mechanism 21 and the movable chuck mechanism 22 in a tensioned state.

Next, the distal end of the wire 11 fed through the nozzle 30 is mounted to the mounting member 29*b* of the reel 29 of the movable chuck mechanism 22. At this time, the rod 82*a* of the rotation-restraining cylinder 82 illustrated in FIG. 5 is projected to move the convex engagement member 83 provided to the distal end of the rod 82*a* into the engagement concave portion 74*c*. As a result, the free movement of the nozzle 30 with respect to the supporting member 72 is inhibited.

Moreover, the retractable rod 71*a* of the air cylinder 71 is retracted to move the supporting member 72 away from the core 13. Then, the nozzle 30 is moved by the nozzle moving mechanism 31 and the feed mechanism 60 so that a fed end portion of the wire 11 faces the reel 29 provided coaxially with the movable chuck mechanism 22. In this state, as illustrated in FIG. 2, the reel 29 is rotated together with the movable chuck mechanism 22 by the winding mechanism 20 to wind the wire 11 fed through the nozzle 30 around the reel 29 of the movable chuck mechanism 22.

After that, the nozzle 30 is moved by the feed mechanism 60 to draw the wire 11 fed through the nozzle 30 through one of the cutouts 29*a* formed on the side wall of the reel 29 of the movable chuck mechanism 22 toward the core 13. The nozzle 30 is moved by driving the driving motor 68 of the feed mechanism 60 to rotate the threaded shaft 64 to move the movable plate 66 together with the nozzle 30 in the Y-axis direction (see FIG. 1).

After the wire 11 is drawn through the one of the cutouts 29*a* toward the core 13, a profile-winding step is carried out. In the profile-winding step, as illustrated in FIG. 5, the rod 82*a* of the rotation-restraining cylinder 82 is retracted to disengage the convex engagement member 83 from the engagement concave portion 74*c* so as to allow the free movement of the nozzle 30 with respect to the supporting member 72. The retractable rod 71*a* of the air cylinder 71 is projected to move the supporting member 72 closer to the core 13. In this manner, the distal end of the nozzle 30, through which the wire 11 is fed, is located close to the core 13.

Moreover, the retractable rod 85*a* of the air cylinder 85 of the guide member 84 is projected to move the vertical member 86 from the nozzle 30 side to become closer to the core 13. As a result, the pair of rollers 87 provided to the vertical member 86 supports the core 13 from the nozzle 30 side in the X-axis direction. Therefore, the core 13 made of a linear material can be prevented from being curved toward the nozzle 30.

After that, the core 13 provided in a tensioned state is rotated. Specifically, the fixed chuck mechanism 21 and the movable chuck mechanism 22 are rotated in synchronization with each other by the winding mechanism 20 illustrated in FIGS. 2 and 3. As a result, the core 13 provided between the fixed chuck mechanism 21 and the movable chuck mechanism 22 in a tensioned state also rotates in synchronization with the fixed chuck mechanism 21 and the movable chuck mechanism 22.

Then, in synchronization with the rotation of the core 13, the nozzle 30 is moved from the movable chuck mechanism 22 side in the Y-axis direction toward the fixed chuck mechanism 21. As a result, the wire 11 fed through the nozzle 30 can be wound around the outer circumference of the core 13. FIG. 6 illustrates the case where the wire 11 is wound by the profile winding to form each turn (one turn of the wire 11 around the outer circumference of the core 13) along the last formed turn 11*a* adjacent thereto.

As described above, the center of the supporting member 72 is opposed to the last formed turn 11*a* or the previous turn of the wire 11 wound around the core 13. As a result, the nozzle 30 is caused to move so as to face the last formed turn 11*a* or the previous turn, as indicated by the alternate long and short dash line in FIG. 6. Therefore, the wire 11 fed through the nozzle 30 can be pressed against the last formed turn 11*a*. Then, when the wire 11 is wound to make one turn, the thus formed turn of the wire 11 is naturally pushed out by the last formed turn 11*a* (along the wire) in a direction in which the wire winding proceeds. Thus, the wire is wound so that the newly formed turn is adjacent to the last formed turn 11*a*.

Therefore, as the profile winding proceeds, the nozzle 30 for feeding the wire 11 in the vicinity of the core 13 gradually moves together with the mounting member 74 in the direction in which the winding proceeds with respect to the supporting member 72 against the biasing force of the spring 78. At this time, the biasing force of the spring 78 is exerted so as to press the wire 11 against the last formed turn 11*a*. Thus, the wire 11 is wound around the core 13 while being appropriately held in close contact with the last formed turn 11*a* adjacent thereto.

The controller controls the feed mechanism 60 to move the supporting member 72 by a length equal to the diameter of the wire 11 during a period in which the core 13 rotates at 360 degrees. At this time, when the nozzle 30 moves with respect to the supporting member 72 due to a variation in the diameter of the wire 11 or the like, the amount of movement of the nozzle 30 is detected by the proximity sensor 81. Then, the controller performs control so that the movement of the supporting member 71 caused by the feed mechanism 60 is adjusted based on the detection output from the proximity sensor 81.

The control is performed by the controller to, for example, move the supporting member 72 so that the amount of movement of the nozzle 30 with respect to the supporting member 72 becomes zero. At this time, the controller performs control so that the supporting member 72 is moved by the feed mechanism 60 by the length equal to the diameter of the wire 11 during the period in which the core 13 rotates at 360 degrees.

When the diameter of the wire 11 is larger than the prescribed wire diameter, the nozzle 30 moves excessively by the amount equal to a difference between the diameter of the wire 11 and the prescribed wire diameter with respect to the supporting member 72 during the period in which the core 13 rotates at 360 degrees. Then, the proximity sensor 81 detects that the nozzle 30 has moved excessively with respect to the supporting member 72. In response to a signal from the proximity sensor 81, the controller controls the feed mechanism 60 to move the supporting member 72 excessively by the amount equal to the excessive amount of movement of the nozzle 30 during a period in which the core 13 rotates at another 360 degrees. As a result, the amount of movement of the nozzle 30 with respect to the supporting member 72 is controlled to be zero.

On the other hand, when the diameter of the wire 11 is smaller than the prescribed wire diameter, the nozzle 30 is moved with respect to the supporting member 72 with a delay corresponding to a difference between the diameter of the wire 11 and the prescribed wire diameter during the period in which the core 13 rotates at 360 degrees. Then, the proximity sensor 81 detects that the nozzle 30 has moved with the delay with respect to the supporting member 72. In response to a signal from the proximity sensor 81, the controller controls the feed mechanism 60 to move the supporting member 72 with a delay corresponding to the delay in the movement of the nozzle 30 during a period in which the core 13 rotates at another 360 degrees. As a result, the amount of movement of the nozzle 30 with respect to the supporting member 72 is controlled to be zero.

As described above, by setting the amount of movement of the nozzle 30 with respect to the supporting member 72 to zero, the excessive rotation of the rotary plate 77 can be restrained. Therefore, the biasing force of the spring 78 can be kept substantially constant to carry out the stable winding.

In this embodiment, the wire feeding member is the nozzle 30 which is mounted to the supporting member 72 so as to be movable in the axial direction of the core 13. Therefore, by moving the distal end edge of the nozzle 30, through which the wire 11 is fed, closer to the core 13, the wire 11 fed through the nozzle 30 can be prevented from being misaligned before reaching the core 13. Therefore, the wire 11 can be relatively accurately guided to a desired winding position.

Moreover, the guide member 84 for supporting the core 13 is provided in the vicinity of the nozzle 30. Therefore, even when the core 13 is thin and relatively long, and is therefore likely to be curved because of its length, the core 13 can be prevented from being pulled by the wire 11 to be curved toward the nozzle 30. Thus, the wire 11 can be accurately wound around the outer circumference of the core 13 by the profile winding.

Moreover, the amount of movement of the nozzle 30 with respect to the supporting member 72 is detected by the proximity sensor 81. Thus, the amount of movement of the nozzle 30 with respect to the supporting member 72 can be detected in an extremely small unit. The controller adjusts the amount of movement of the supporting member 72 by the feed mechanism 60 based on the detection output from the proximity sensor 81. Thus, the amount of shift of the nozzle 30 can be adjusted in an extremely small unit. Therefore, by winding the wire 11 along the side surface of the last formed turn 11*a*, the regular winding for winding the wire 11 along the last formed turn 11*a* is enabled even when the core 13 is thin and relatively long. Then, when the winding of the wire 11 over a desired range of the core 13 is completed, the profile-winding step is terminated.

Subsequently, the wire-winding step with the nozzle being fixed (hereinafter referred to as "nozzle-fixed wire-winding step") is carried out. The wire winding apparatus 10 includes the lock mechanism 79 for inhibiting the operation of the nozzle 30. Therefore, the nozzle-fixed wire-winding step is carried out by moving the supporting member 72 with respect to the core 13 in a state in which the movement of the nozzle 30 with respect to the supporting member 72 is inhibited.

Figure 7:
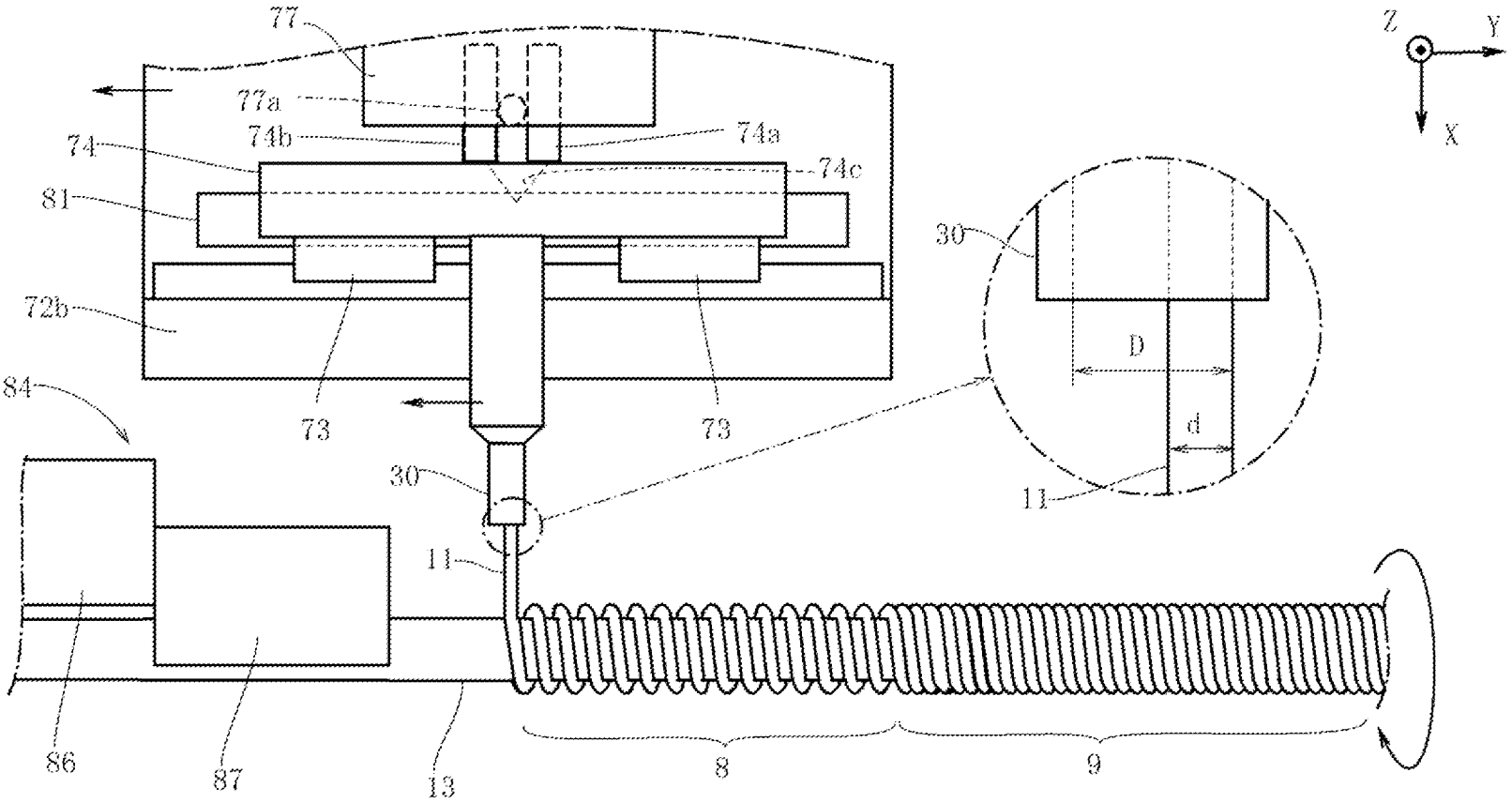
FIG. 7 is a diagram corresponding to FIG. 6, for illustrating a state in which wire winding with the nozzle being fixed is performed after profile winding.

Specifically, the rod 82*a* of the rotation-restraining cylinder 82 illustrated in FIG. 5 is projected to move the convex engagement member 83 provided to the distal end of the rod 82*a* into the engagement concave portion 74*c*. The convex engagement member 83 inhibits the free movement of the mounting member 74 with respect to the supporting member 72. In this state, the supporting member 72 is moved with respect to the core 13. FIG. 7 illustrates the case where the supporting member 72 is moved together with the nozzle 30 by the amount larger than the outer diameter d of the wire 11 during a period in which the core 13 rotates at 360 degrees to wind the wire 11 fed through the nozzle 30 around the core 13 to form the turns at predetermined intervals.

In this case, as illustrated in an enlarged part of FIG. 7, even when the inner diameter D of the distal end of the nozzle 30, through which the wire 11 is fed, is larger than the outer diameter d of the wire 11, the nozzle 30 moves together with the supporting member 72 to exceed the range of the outer diameter of the wire 11 during the period in which the core 13 rotates at 360 degrees. Therefore, the wire 11 fed through the nozzle 30 is fed obliquely from behind, that is, from a direction opposite to the direction in which the winding proceeds for the nozzle 30. Accordingly, the wire 11 can be reliably wound around the core 13 with a predetermined pitch. Then, at the time when the winding of the wire over a desired range of the core 13 is completed with the nozzle 30 being fixed, the nozzle-fixed wire-winding step is terminated.

Therefore, by alternately carrying out the profile-winding step illustrated in FIG. 6 and the nozzle-fixed wire-winding step illustrated in FIG. 7, a coil 9 obtained by the profile winding and a coil 8 obtained by the nozzle-fixed wire-winding step can be alternately obtained. Therefore, various types of windings can be obtained.

After the desired coils 8 and 9 are obtained, the nozzle 30 is moved away from the core 13 again by the nozzle moving mechanism 31 in a state in which the free movement of the nozzle 30 with respect to the supporting member 72 is inhibited. At the same time, the nozzle 30 is moved in the Y-axis direction by the feed mechanism 60. In this manner, the distal end of the wire 11, which is the fed end of the wire, is opposed to the reel 29 provided coaxially with the fixed chuck mechanism 21. At this time, the wire 11 fed through the nozzle 30 is drawn onto an outer circumference of the reel 29 through one of the cutouts 29*a* formed on the side wall of the reel 29 of the fixed chuck mechanism 21 (see FIGS. 2 and 3). By rotating the reel 29 together with the fixed chuck mechanism 21 by the winding mechanism 20 in this state, the wire 11 fed through the nozzle 30 is wound around the reel 29 of the fixed chuck mechanism 21 to form a terminal end.

As described above, the wire winding apparatus 10 includes the lock mechanism 79 for locking the operation of the nozzle 30. Therefore, the supporting member 72 can be moved with respect to the core 13 in a state in which the movement of the nozzle 30 with respect to the supporting member 72 is inhibited. Therefore, the wire 11 can be accurately drawn at the start of winding and the end of winding. Thus, appropriate winding with high accuracy can be performed while ensuring high adaptability to various winding conditions.

After that, the nozzle 30 is moved away from the core 13 together with the supporting member 72 by the air cylinder 71. Then, the wire 11 is gripped by the sandwiching teeth 89*a* of the clamp mechanism 89. After that, the nipper mechanism 93 is moved down by the vertically-movable cylinder 92 so that the wire 11 is cut by the cutting blades 93*a* of the nipper mechanism 93. Then, the coils 8 and 9 are removed from the core 13.

The removal operation is performed in a state in which the core 13 is released from the tensioned state. Specifically, as indicated by the arrow in alternate long and short dash line in FIG. 2, the movable base 26*a* of the chuck moving mechanism 26 is moved together with the movable bearing 24 to move the movable chuck mechanism 22 pivotably supported by the movable bearing 24 closer to the fixed chuck mechanism 21. In this state, the another end of the core 13, which is chucked by the movable chuck mechanism 22, is released. Similarly, the one end of the core 13, which is chucked by the fixed chuck mechanism 21, is released. As a result, the coils 8 and 9 formed around the core 13 are removed together with the core 13 from the winding mechanism 20. Then, after the core 13 is removed from the coils 8 and 9, the coils 8 and 9 are obtained.

According to the embodiment described above, the following effects are obtained.

In the wire winding apparatus 10 and the wire winding method according to this embodiment, the wire feeding member is the nozzle 30 mounted to the supporting member 72 so as to be movable in the axial direction of the core 13. Therefore, by moving the distal end edge of the nozzle 30, through which the wire 11 is fed, closer to the core 13, the wire 11 fed through the nozzle 30 can be prevented from being misaligned before reaching the core 13. Therefore, the wire 11 can be relatively accurately guided to a desired winding position.

Moreover, the amount of movement of the nozzle 30 with respect to the supporting member 72 is detected by the proximity sensor 81. Therefore, the amount of movement of the nozzle 30 with respect to the supporting member 72 can be detected in an extremely small unit. Further, the amount of movement of the supporting member 72 by the feed mechanism 60 is adjusted based on the detection output from the proximity sensor 81, and therefore the amount of shift of the nozzle 30 can be adjusted in an extremely small unit. Thus, by winding the wire 11 along the side surface of the last formed turn 11*a*, the regular winding for winding the wire 11 along the last formed turn 11*a* is enabled even when the core 13 is thin and relatively long.

Further, the wire winding apparatus 10 includes the lock mechanism 79 for locking the operation of the nozzle 30. Therefore, an operation in a nozzle-fixed wire-winding mode for moving the supporting member 72 with respect to the core 13 in a state in which the movement of the nozzle 30 with respect to the supporting member 72 is inhibited can be performed. Therefore, appropriate wire winding with high accuracy can be performed while ensuring high adaptability to various winding conditions.

Further, the guide member 84 for supporting the core 13 is provided in the vicinity of the nozzle 30. Thus, even when the core 13 is a thin and relatively long linear material, and therefore is likely to be curved because of its length, the core 13 is prevented from being pulled by the wire 11 to be curved toward the nozzle 30. Thus, the wire 11 fed through the nozzle 30 can be immediately wound around the core 13. Therefore, even when the core 13 is thin and relatively long, the wire 11 can be relatively easily wound around the outer circumference of the core 13 by the regular winding.

Embodiments of this invention were described above, but the above embodiments are merely examples of applications of this invention, and the technical scope of this invention is not limited to the specific constitutions of the above embodiments.

For example, the above-mentioned embodiment describes the case where the ends of the core 13 are respectively supported and pulled by the fixed chuck mechanism 21 and the movable chuck mechanism 22. However, the core 13 is not required to be provided in a tensioned state as long as the core 13 has no risk of being deflected or buckling. In this case, only one end of the core 13 may be supported.

Although the above-mentioned embodiment has been described using the core 13 made of the linear material provided between the fixed chuck mechanism 21 and the movable chuck mechanism 22 in a tensioned state, the core 13 may be a thinner one. For example, a wire, a piano wire, or a stainless steel wire may be used as the core 13. Even in this case, deflection of the core 13 can be effectively prevented by providing the guide member 84. When a thin piano wire is used, a relatively thin coil can be obtained.

Further, the above-mentioned embodiment describes the case where the wire 11 is temporarily wound around the reel 29 of the fixed chuck mechanism 21 at the end of the winding for each layer. However, the winding may be terminated without drawing the wire 11 onto the outer circumference of the reel 29 of the fixed chuck mechanism 21 at the end of the winding for each layer.

Further, the above-mentioned embodiment describes the case where the coils 8 and 9 formed around the core 13 are removed together with the core 13 from the winding mechanism 20. However, when the core 13 can be curved, for example, is made of a linear material, the coils 8 and 9 may be removed in the following manner. Specifically, after one of the chucked ends of the core 13 is released, the coils 8 and 9 formed by winding the wire 11 around the core 13 are moved from the end to another end so as to be removed therefrom.

Further, in the embodiment described above, the spring 78 is used as the biasing mechanism 75 for pulling back the nozzle 30 to the approximate center in the Y-axis direction above the supporting member 72. However, the present invention is not limited to the above-mentioned embodiment. For example, an elastic member other than the spring or an actuator such as an air cylinder or a torque motor may be used as the biasing mechanism.

Further, the above-mentioned embodiment describes the case where the wire 11 is wound around the core 13 to form a single layer. However, the winding of the present invention is not limited thereto. Although not shown, a coil formed of two layers or a coil formed of a plurality of layers equal to or more than three layers may be obtained.

This application claims priority based on Japanese Patent Application No. 2012-148980 filed with the Japan Patent Office on Jul. 3, 2012, the entire contents of which are incorporated into this specification.

The embodiments of this invention in which an exclusive property or privilege is claimed are defined as follows:

What is claimed is:

1. A wire winding apparatus for winding a wire around an outer circumference of a core, the wire winding apparatus comprising:

a wire feeding member provided to a supporting member so as to be operable, for feeding the wire;

a lock mechanism capable of inhibiting an operation of the wire feeding member;

a winding mechanism for rotating the core about an axis thereof to wind the wire fed from the wire feeding member around the outer circumference of the core;

a feed mechanism for moving the supporting member in an axial direction of the core in synchronization with the winding performed by the winding mechanism;

a proximity sensor for detecting a movement amount of the wire feeding member with respect to the supporting member; and a control section for controlling an operation of the feed mechanism to adjust a movement amount of the supporting member moved by the feed mechanism based on a detection output from the proximity sensor.

2. A wire winding apparatus according to claim 1, wherein the wire feeding member comprises a nozzle mounted to the supporting member so as to be movable in the axial direction of the core.

3. A wire winding apparatus according to claim 2, wherein:

the core is made of a linear material; and the wire winding apparatus further comprises a guide member provided in vicinity of the nozzle, for supporting the core.

4. A wire winding apparatus according to claim 2, further comprising a biasing mechanism for biasing the nozzle so that the nozzle is located at a predetermined position above the supporting member.

5. A wire winding method for moving a wire feeding member for feeding a wire in an axial direction of a core with respect to a supporting member while rotating the core about an axis thereof to wind the wire fed from the wire feeding member around the core, the wire winding method comprising:

a profile-winding step of adjusting a movement amount of the supporting member based on a detection output from a proximity sensor for detecting a movement amount of the wire feeding member with respect to the supporting member to wind the wire fed from the wire feeding member so as to be guided by a last formed turn of the wire around the core; and a wire-winding step of winding, with the wire feeding member being fixed, the wire fed from the wire feeding member around the core while moving the supporting member at a constant speed with respect to the core in a state in which movement of the wire feeding member with respect to the supporting member is inhibited.

* * * * *